US008301047B2

(12) United States Patent
Imahori et al.

(10) Patent No.: US 8,301,047 B2
(45) Date of Patent: Oct. 30, 2012

(54) IMAGE FORMING APPARATUS AND METHOD OF CONTROLLING DEVELOPMENT ELECTRIC FIELD STRENGTH THEREIN

(75) Inventors: Masaaki Imahori, Hitachinaka (JP); Masayoshi Nakayama, Mito (JP)

(73) Assignee: Ricoh Company, Ltd., Tokyo (JP)

( * ) Notice: Subject to any disclaimer, the term of this patent is extended or adjusted under 35 U.S.C. 154(b) by 403 days.

(21) Appl. No.: 12/709,034

(22) Filed: Feb. 19, 2010

(65) Prior Publication Data

US 2010/0215389 A1 Aug. 26, 2010

(30) Foreign Application Priority Data

Feb. 20, 2009 (JP) ..... 2009-038055

(51) Int. Cl.
*G03G 15/00* (2006.01)
*G03G 15/22* (2006.01)

(52) U.S. Cl. ..... 399/46; 399/26; 399/49; 399/53; 399/55

(58) Field of Classification Search ..... 399/31, 399/46, 48, 53, 55, 159–165, 24, 26, 49, 399/56

See application file for complete search history.

(56) References Cited

U.S. PATENT DOCUMENTS 5,253,018 A * 10/1993 Takeuchi et al. ..... 399/49
7,379,681 B2 * 5/2008 Mine et al. ..... 399/48
2004/0052554 A1 * 3/2004 Harada et al. ..... 399/301
2007/0274742 A1 11/2007 Nakayama et al.
2007/0280744 A1 12/2007 Kubo et al.
2008/0199205 A1 8/2008 Kubo et al.
2008/0199223 A1 8/2008 Tateyama et al.
2008/0213006 A1 9/2008 Nakayama et al.
2008/0226316 A1 * 9/2008 Koshimura et al. ..... 399/49
2008/0247786 A1 10/2008 Nakayama et al.
2009/0103954 A1 4/2009 Nakayama et al.

FOREIGN PATENT DOCUMENTS

JP 2003-255652 9/2003
JP 2007-33770 2/2007
JP 2008-76576 4/2008

* cited by examiner

*Primary Examiner* — Walter L Lindsay, Jr.
*Assistant Examiner* — Jessica L Eley
(74) *Attorney, Agent, or Firm* — Oblon, Spivak, McClelland, Maier & Neustadt, L.L.P.

(57) ABSTRACT

An image forming apparatus includes an image carrier, a developer carrier, a runout measurement information storage unit to store runout measurement information of the image carrier and the developer carrier, including runout amounts on the circumference of the image and developer carriers in a development area, a development gap measurement information storage unit to store information obtained by measuring a development gap when runout measurement points of the image and developer carriers face each other, and a development electric field strength control unit to obtain each development electric field strength based on the runout measurement information and the development gap measurement information, and determine control contents of development electric field strength control to cause the entire development electric field strengths to fall within an acceptable range of a target electric field strength to perform the control contents.

9 Claims, 8 Drawing Sheets

FIG. 10
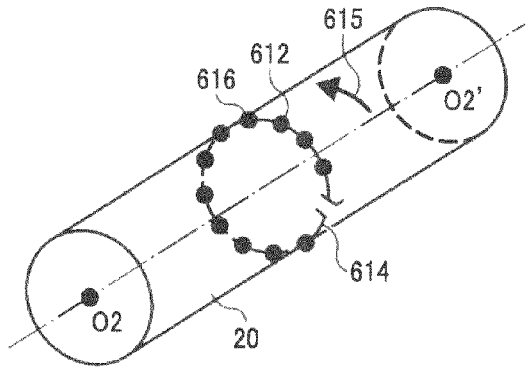
FIG. 11
| MEASUREMENT NO. | PHOTOCONDUCTOR RUNOUT [um] |
|---|---|
| 1 | 0 |
| 2 | 15 |
| ⋮ | ⋮ |
| n2 | -10 |
660
661
FIG. 12
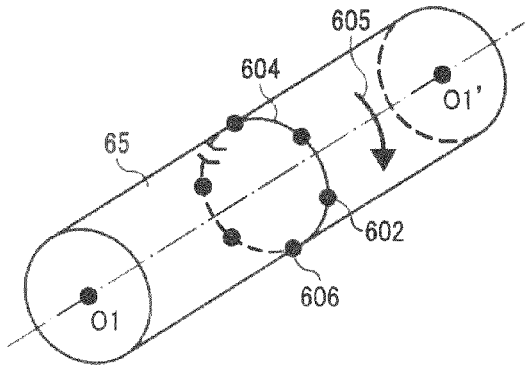

FIG. 13

NUMBER OF LINES OF RUNOUT INFORMATION: n2

| MEASUREMENT NO. | DEVELOPMENT SLEEVE RUNOUT [um] |
|---|---|
| 1 | 0 |
| 2 | -10 |
| . | . |
| n1 | 20 |
| 1 | 0 |
| 2 | -10 |
| . | . |
| n1 | 20 |
| 1 | 0 |
| 2 | -10 |
| . | . |
| n1 | 20 |
| 1 | 0 |
| 2 | -10 |
| . | . |
| n1 | 20 |

650

651

FIG. 14

| MEASUREMENT NO. | DEVELOPMENT GAP [um] |
|---|---|
| 1 | 350 (d1) |
| 2 | 345 |
| . | . |
| k | dk |
| . | . |
| n2 | 340 |

670

671

FIG. 15
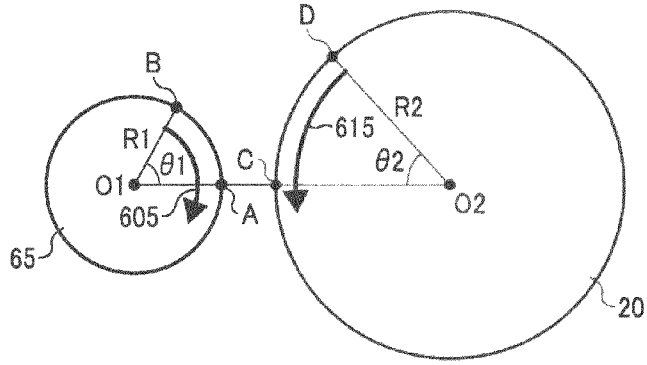
FIG. 16
| TIME t [s] | CORRECTED LASER EMISSION POWER [uW] |
|---|---|
| 0 | |
| t | |
| ⋮ | ⋮ |
| (n2−1)×t | |
FIG. 17
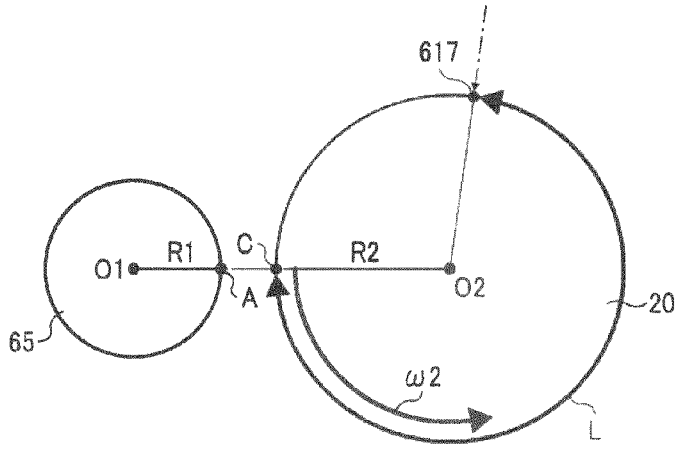

IMAGE FORMING APPARATUS AND METHOD OF CONTROLLING DEVELOPMENT ELECTRIC FIELD STRENGTH THEREIN

CROSS-REFERENCE TO RELATED APPLICATIONS

The present invention claims priority pursuant to 35 U.S.C. §119 from Japanese Patent Application No. 2009-038055, filed on Feb. 20, 2009 in the Japan Patent Office, which is hereby incorporated by reference herein in its entirety.

BACKGROUND OF THE INVENTION

1. Field of the Invention

Example embodiments of the present invention generally relate to an image forming apparatus and a method of controlling a development electric field strength generated therein, and more particularly, to an image forming apparatus such as a copier, printer, or facsimile machine, in which an electrostatic latent image is developed into a toner image by attracting toner to adhere to the electrostatic latent image by action of a development electric field formed between the electrostatic latent image formed on an image carrier and a surface of a developer carrier, and a method of controlling a development electric field strength generated between a development gap formed by a development sleeve and a photoconductor incorporated in the image forming apparatus.

2. Discussion of the Related Art

Known electrophotographic image forming apparatuses generally control electric potential setting values at given intervals to adjust various electric potentials such as charge target potentials and developing biases, so as to control image quality factors such as image density. In this adjustment of potential setting values, multiple reference toner images that serve as predetermined adjustment toner patterns are generally formed on the surface of a latent image carrier such as a photoconductor, and then the toner adhesion amount of each of the reference toner images is detected. Then, based on a linear approximation equation of a development electric potential in forming the reference toner images and the toner adhesion amount of each reference toner image, a development electric potential is calculated to obtain a desired toner adhesion amount, and various potentials are calculated to obtain that desired development electric potential. The term "development electric potential" means a difference between a potential of an area on the surface of the latent image carrier where the electrostatic latent image is formed and a surface potential of a developer carrier to which a developing bias is applied.

With such image forming apparatuses, a cylindrical developer carrier and a cylindrical latent image carrier are generally disposed facing each other across a given gap, hereinafter referred to as a "development gap", and are driven to rotate separately. By the action of a development electric field generated according to the development electric potential, toner attracted to the surface of the developer carrier is transferred onto the surface of an electrostatic latent image formed on the latent image carrier so that the electrostatic latent image is developed into a visible toner image. It is to be noted that, with the above-described configuration, the developer carrier and the latent image carrier may cause respective runouts on the outer circumferences thereof with respect to respective rotation drive shafts. The term "runout" refers to variation or out-of-round on the circumference of the developer carrier and that of the latent image carrier.

Here, if the development gap is represented by "d [m]" and the development electric potential that can be obtained by the above-described potential setting value control is represented by "Vpot [V]", then a development electric field strength "E [V/m]" can be obtained by Equation 1 described below:

$$E = V\text{pot}/d \qquad \text{Equation 1.}$$

As the developer carrier and the latent image carrier rotate, the runouts on the outer circumference thereof cause the development gap to fluctuate, which in turn can cause the development electric field strength E to fluctuate. When the development electric field strength E fluctuates, an amount of toner that is transferred onto the electrostatic latent image formed on the surface of the latent image carrier also fluctuates. Therefore, the fluctuation in the development gap due to the runouts on the outer circumferences of the developer carrier and the latent image carrier can cause image density nonuniformity (hereinafter simply "density nonuniformity") of an output image, resulting in a defective image.

To eliminate such density nonuniformity, improvement in runout accuracies of the developer carrier and the image carrier is required. With increasing market demand in recent years for an increase in speed of electrophotographic image forming apparatuses, developer carriers and image carriers have tended to increase in diameter size, which makes it difficult to improve the runout accuracies thereof. Further, even if the runout accuracies are successfully improved, it is likely that such improvement is accompanied by an increase in the cost of the apparatus.

Various techniques have been proposed to correct density nonuniformity caused by fluctuation in the size of the development gap. One technique, for example, discloses that density nonuniformity caused by runout in a developer carrier can be eliminated by adjusting the speed of rotation of the developer carrier. However, this approach does not take into account runout in an image carrier, and therefore is not wholly sufficient to suppress the density nonuniformity caused by fluctuation of a development gap.

Further, the above-described technique needs to obtain the current density nonuniformity, and therefore, in addition to multiple reference toner images formed when adjusting conventional potential setting values, other reference toner image(s) may need to be formed on the latent image carrier. Accordingly, problems such as an increase in downtime of the image forming apparatus along with an extended time required for implementing the potential setting value control and an increase in toner consumption amount remain.

SUMMARY OF THE INVENTION

Exemplary aspects of the present invention have been made in view of the above-described circumstances.

Exemplary aspects of the present invention provide an image forming apparatus that can effectively prevent density nonuniformity caused by fluctuation of a development gap due to runout of a development sleeve and runout of a photoconductor without increasing machine-down time and/or toner consumption amount.

Further, another exemplary aspects of the present invention is that a method of controlling a development electric field strength performed in the image forming apparatus, which can effectively conduct the prevent density noninumiformity.

In one exemplary embodiment, an image forming apparatus includes an image carrier, a latent image writing device, a developing unit including a developer carrier, a runout measurement information storage unit, a development gap measurement information storage unit, and a development electric field strength control unit. The image carrier carries an image on a surface thereof and rotate in a given direction. The latent image writing device optically writes an electrostatic latent image on the surface of the image carrier by changing a surface electric potential of the image carrier. The developer carrier is disposed facing the image carrier in a development area of the image forming apparatus and carries developer consisting essentially of toner and carrier on a surface thereof and rotating in a given direction. The developing unit attracts the toner adhering to the surface of the developer carrier to the electrostatic latent image formed on the surface of the image carrier to develop the electrostatic latent image in a development electric field formed between the electrostatic latent image on the surface of the image carrier and the surface of the developer carrier into a visible toner image that is then transferred onto a recording medium. The runout measurement information storage unit stores runout measurement information of the image carrier and runout measurement information of the developer carrier. The runout measurement information of the image carrier includes runout amounts on the circumference of the image carrier in the development area and associates runout amount data obtained by measuring multiple runout measurement points located on the surface of the image carrier in a direction of movement of the surface of the image carrier with runout measurement point data indicating each of the multiple runout measurement points. The runout measurement information of the developer carrier includes runout amounts on the circumference of the developer carrier in the development area and associates runout amount data obtained by measuring multiple runout measurement points located on the surface of the developer carrier in a direction of movement of the surface of the developer carrier with runout measurement point data indicating each of the multiple runout measurement points. The development gap measurement information storage unit stores development gap measurement information obtained by measuring a development gap at a time when a runout measurement point indicated in at least one of the runout measurement point data of the runout measurement information of the image carrier and a runout measurement point indicated in at least one of the runout measurement point data of the runout measurement information of the developer carrier come to face each other. The development electric field strength control unit obtains development electric field strength each time the runout measurement point indicated in the multiple runout measurement point data of the runout measurement information of the image carrier and the runout measurement point indicated in the multiple runout measurement point data of the runout measurement information of the developer carrier come to face each other in the development area, based on the runout measurement information of the image carrier and the runout measurement information of the developer carrier stored in the runout measurement information storage unit and the development gap measurement information stored in the development gap measurement information storage unit, determines contents of development electric field strength control to cause all obtained development electric field strengths to fall within an acceptable target range for the development electric field strength, and performs development electric field strength control according to the contents.

The development electric field strength controller may control the latent image writing device to adjust a potential of an electrostatic latent image formed on each runout measurement point on the surface of the image carrier that corresponds to each of the development electric field strengths.

The image carrier may be a photoconductor and the latent image writing device may be an exposure unit to change a surface potential of the image carrier by exposing the surface of the image carrier. The image forming apparatus may further include a surface potential detector to detect the surface potential of the latent image carrier, a toner adhesion detector to detect a toner adhesion amount of a given reference toner image, and an image density adjusting unit to adjust image density by obtaining a relation between a potential of an electrostatic latent image formed by the latent image writing device on the image carrier and an exposure intensity of the latent image writing device based on detection results obtained by the surface potential detector and detection results obtained by the toner adhesion detector and adjust the exposure intensity of the latent image writing device based on the relation to obtain a target potential of the electrostatic latent image for obtaining a predetermined image density. The development electric field strength controller may determine the contents of the development electric field strength control after the image density adjusting unit has adjusted the image density.

The runout measurement information of the image carrier and the development gap measurement information may be obtained based on respective runout amounts measured at the multiple runout measurement points located on the surface of the image carrier that pass through the detection area where the surface potential detector performs detection.

The development electric field strength control unit may control the latent image writing device to adjust the exposure strength of the latent image writing device based on the relation obtained by the image density adjusting unit, so that an electric potential of the electrostatic latent image formed at each runout measurement point on the surface of the image carrier causes the entire development electric field strength for the electric potential to fall within an acceptable target range for the electric field strength.

The development electric field strength control unit may determine the contents of the development electric field strength control each time information stored in at least one of the runout measurement information storage unit and the development gap measurement information storage unit is updated.

With the above-described image forming apparatus, a relation $\omega 1/\omega 2=n2/n1$ may be satisfied, where "n1" represents the number of runout measurement points included in the runout measurement information of the developer carrier, "n2" represents the number of runout measurement point data included in the runout measurement information of the image carrier, "ω1" represents an angular velocity at rotation of the developer carrier, and "ω2" represents an angular velocity at rotation of the image carrier.

The runout measurement information of the image carrier may include the runout amount data in which the runout measurement points thereof are arranged in a direction of rotation of the image carrier, and the runout measurement information of the developer carrier may include the runout amount data in which the runout measurement points thereof are arranged in a direction of rotation of the developer carrier.

In another exemplary embodiment, a method of controlling a development electric field strength includes measuring multiple runout measurement points located on a surface of an image carrier of an image forming apparatus in a direction of movement of the surface of the image carrier, obtaining runout amount data of runout amounts at the multiple runout measurement points on the circumference of the image carrier in a development area, storing the runout amount data associated with runout measurement point data indicating each of the multiple runout measurement points, as runout measurement information of the image carrier in a runout measurement information storage unit, measuring multiple runout measurement points located on a surface of a developer carrier of the image forming apparatus in a direction of movement of the surface of the developer carrier, obtaining runout amount data of runout amounts at the multiple runout measurement points on the circumference of the developer carrier in the development area, storing the runout amount data associated with runout measurement point data indicating each of the multiple runout measurement points, as runout measurement information of the developer carrier in the runout measurement information storage unit, measuring a development gap formed between the developer carrier and the imaging carrier when a runout measurement point indicated in at least one of the runout measurement point data of the image carrier and a runout measurement point indicated in at least one of the runout measurement point data of the developer carrier come to face each other in the development area, storing the development gap as development gap measurement information in a development gap measurement information storing unit, obtaining development electric field strength each time the runout measurement point indicated by the multiple runout measurement point data of the runout measurement information of the image carrier and the runout measurement point indicated by the multiple runout measurement point data of the runout measurement information of the developer carrier come to face each other in the development area, based on the runout measurement information of the image carrier and the runout measurement information of the developer carrier stored in the runout measurement information storage unit and the development gap measurement information stored in the development gap measurement information storage unit, determining development electric field strength control contents to cause all obtained development electric field strengths to be set within an acceptable target range for the development electric field strengths, and performing development electric field strength control according to the contents of the development electric field strength control.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 10 is a perspective view illustrating a measurement point of runout amount on the photoconductor according to runout amount measurement point;

FIG. 11 is a view for explaining information of runout amount measurement of a photoconductor, including data of runout amounts thereof obtained by measurement results obtained at a runout amount measurement point of each photoconductor;

FIG. 12 is a perspective view illustrating a measurement point of runout amount on the development sleeve;

FIG. 13 is a table for explaining information of runout amount measurement of a development sleeve, including data of runout amounts thereof obtained by measurement results obtained at a runout amount measurement point of each development sleeve;

FIG. 14 explains the contents of a table for development gap;

FIG. 15 is a view for explaining relative positions of rotation of a photoconductor and a development sleeve provided to the image forming apparatus of FIG. 1;

FIG. 16 is a view for explaining the content of a table for laser emission power; and FIG. 17 is a view for explaining relative positions of respective positions of rotation of a photoconductor and a development sleeve and a laser writing position in the image forming apparatus of FIG. 1.

DETAILED DESCRIPTION OF THE PREFERRED EMBODIMENTS

Figure 1:
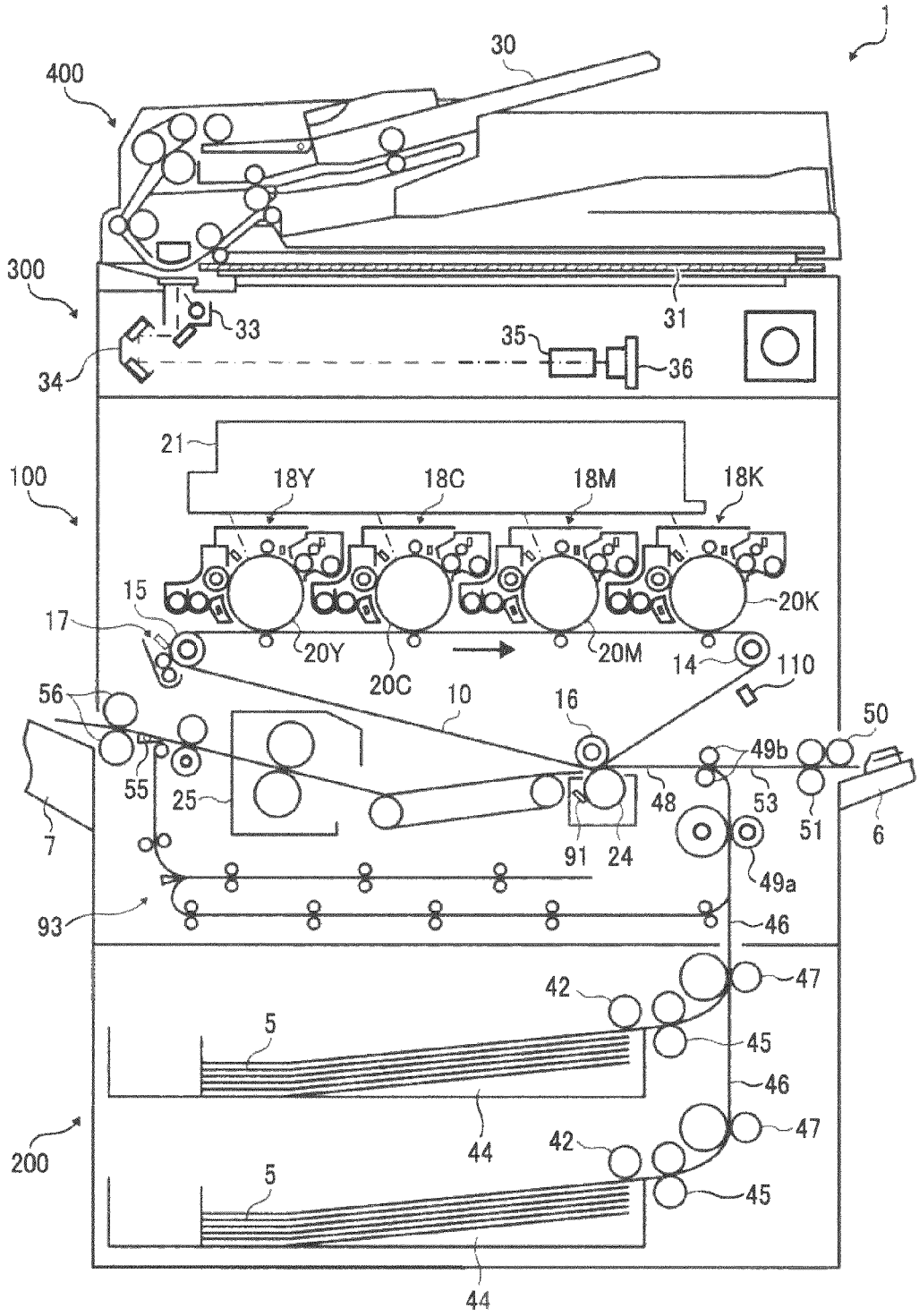
FIG. 1 is a schematic structure of an image forming apparatus according to an exemplary embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would hen be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, exemplary embodiments of the present invention are described.

Now, exemplary embodiments of the present invention are described in detail below with reference to the accompanying drawings.

Descriptions are given, with reference to the accompanying drawings, of examples, exemplary embodiments, modification of exemplary embodiments, etc., of an image forming apparatus according to the present invention.

Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus. For example, the technique of the present invention is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

FIG. 1 shows a schematic view illustrating a schematic structure of an image forming apparatus 1 according to an exemplary embodiment of the present invention.

In FIG. 1, the image forming apparatus 1 includes a printing device 100, a sheet feeding device 200, a scanner 300, and an automatic document feeder (ADF) 400.

The printing device 100 performs image forming operations.

The sheet feeding device 200 is disposed below the printing device 100 to feed a transfer sheet 5 that serves as a recording medium to the printing device 100.

The scanner 300 is placed on top of the printing device 100 to read images of original documents.

The ADF 400 is arranged on the scanner 300 to feed and convey original documents to read with the scanner 300.

The printing device 100 includes a manual sheet feeder 6 to feed the transfer sheet manually and a sheet discharging tray 7 to which the transfer sheet 5 having an image thereon is discharged.

Figure 2:
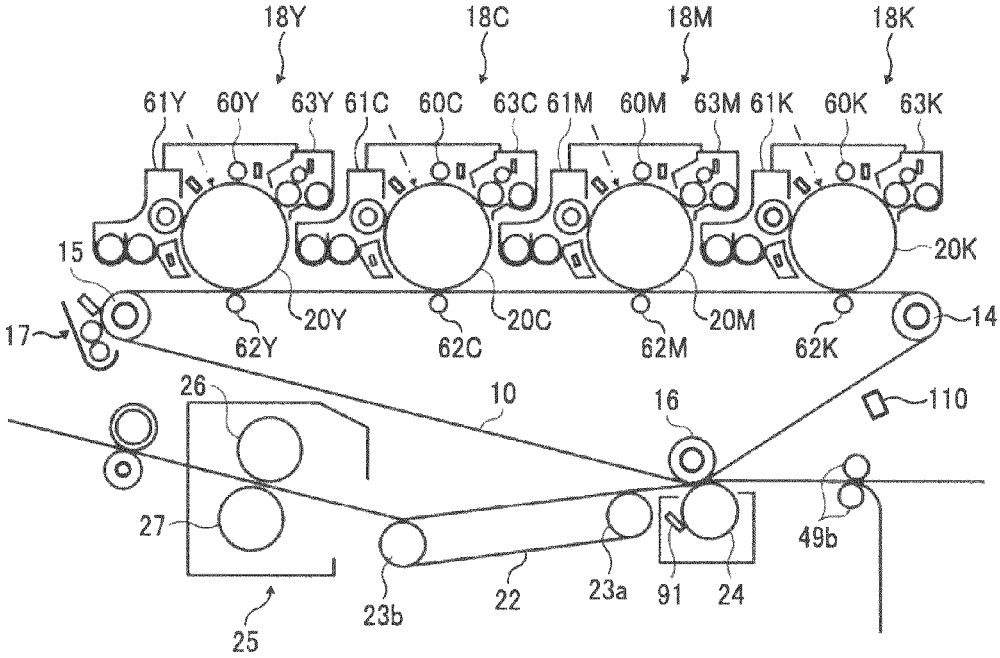
FIG. 2 is an enlarged view illustrating configurations of an intermediate transfer unit and peripheral units in the image forming apparatus of FIG. 1.

FIG. 2 is an enlarged view of a configuration of the printing device 100 of the image forming apparatus 1 of FIG. 1.

The printing device 100 further includes an intermediate transfer belt 10 that serves as an intermediate transfer member with an endless shape. The intermediate transfer belt 10 includes a resin such as polyimide that has a good mechanical characteristic to prevent a positional deviation thereof due to wearout of the belt. The polyimide resin of the intermediate transfer belt 10 includes carbon distributed as charge controlling agent to provide high image quality and high stability, so that the intermediate transfer belt 10 does not relay on temperature and humidity environment and can constantly provide stable transfer ability. Therefore, the intermediate transfer belt 10 is black.

The intermediate transfer belt 10 is spanned around and extended by three supporting rollers 14, 15, and 16 and is rotated in a clockwise direction in FIG. 2. As shown in FIG. 2, four image forming units 18Y (for yellow color), 18C (for cyan color), 18M (for magenta color), and 18K (for black color) are arranged along in a direction of movement of the intermediate transfer belt 10 between the first supporting roller 14 and the second supporting roller 15. Further, an optical sensor 110 that serves as a toner adhesion amount detector is located at a position on which the intermediate transfer belt 10 is extended between the first supporting roller 14 and the third supporting roller 16.

As shown in FIG. 2, an optical writing device 21 that serves as a latent image writing device is disposed above the image forming units 18Y, 18C, 18M, and 18K. Based on image data of a document read by the scanner 300, the optical writing device 21 causes a laser controller (not shown) to drive a semiconductor laser (not shown) so as to emit a writing laser light beam. The laser light beam exposes and scans each surface of drum-shaped photoconductors 20Y, 20C, 20M, and 20K, which serve as image carriers, mounted on the respective image forming units 18Y, 18C, 18M, and 18K so that each electrostatic latent image on the respective surfaces of the photoconductors 20Y, 20C, 20M, and 20K.

A light source of the laser light beam is not limited to a laser diode but can include a light-emitting diode.

Figure 3:
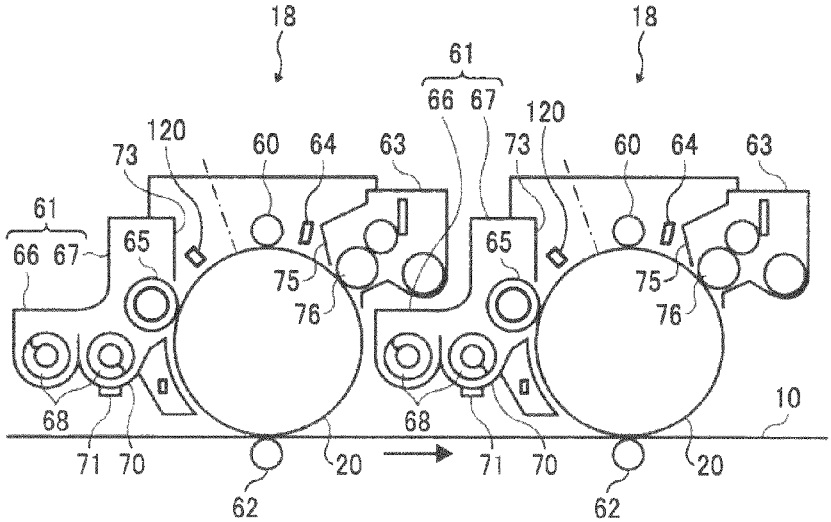
FIG. 3 is an enlarged view illustrating configurations of two of four image forming units provided to the image forming apparatus of FIG. 1.

FIG. 3 is an enlarged view illustrating two of the four image forming units 18Y, 18C, 18M, and 18K.

The four image forming units 18Y, 18C, 18M, and 18K have similar structures and functions, except that respective toners are of different colors, which are yellow, cyan, magenta, and black toners, the discussion below will be applied to any of the image forming units 18Y, 18C, 18M, and 18K when the units and components are described without suffixes.

The image forming unit 18 includes a charging unit 60, a developing unit 61, a photoconductor cleaning unit 63, and a discharging unit 64 arranged around the photoconductor 20.

The image forming unit 18 further includes a primary transfer unit 62 that is disposed facing the photoconductor 20 via the intermediate transfer belt 10.

The charging unit 60 is a contact-charge-type unit that includes a charging roller. The charging roller of the charging unit 60 contacts the photoconductor 20 to apply a given voltage so that the surface of the photoconductor 20 can be uniformly charged. The charging unit 60 is not limited but can include a non-contact-charge-type unit that includes a non-contact scorotron charger.

The developing unit 61 contains two-component developer that includes magnetic carrier particles and non-magnetic toner particles. The developing unit 61 may alternatively contain one-component developer.

The developing unit 61 includes an agitation section 66 and a development section 67, both of which are provided in a development case 70.

In the agitation section 66, two-component developer (hereinafter simply referred to as "developer") are conveyed while being agitated, and supplied onto a development sleeve 65 that serves as a developer carrier. The agitation section 66 includes two parallel screws 68 and a separation panel (not shown) between the two parallel screws 68 so that the agitated developer can communicate through each end of the two parallel screws 68.

A toner density sensor 71 is mounted on the development case 7D to detect toner density of the developer contained in the developing unit 61.

By contrast, in the development section 67, toner particles of the developer that adhere to the development sleeve 65 are transferred onto the photoconductor 20. The development sleeve 65 is disposed in the development section 67 to face the photoconductor 20 through an opening of the development case 70. The development sleeve 65 includes multiple magnets (not shown) fixedly disposed therein. The development section 67 further includes a doctor blade 73 that serves as a developer regulating member so as to cause the leading edge thereof to be disposed close to the development sleeve 65.

While agitating the developer in the developing unit 61, the two parallel screws 68 convey and circulate the developer to supply to the development sleeve 65. The supplied developer is scooped up by magnetic force exerted by a magnet roller disposed in the development sleeve 65 to the surface of the development sleeve 65. The developer scooped to the development sleeve 65 is conveyed along with rotation of the development sleeve 65 and regulated by the doctor blade 73 to an appropriate amount thereof. The excess amount of regulated developer is returned to the agitation section 66. Thus, the developer conveyed to a development area where the development sleeve 65 faces the photoconductor 20 is attracted to the photoconductor 20 by a magnetic force exerted by the magnet roller to form a magnetic brush. In the development area, a developing bias that is applied to the development sleeve 65 causes to form a development electric field to transfer the toner particles in the developer onto an electrostatic latent image formed on the surface of the photoconductor 20. Thus, the toner particles in the developer are transferred onto the electrostatic latent image on the photoconductor 20 so that the electrostatic latent image can be developed to a visible toner image. After passing the development area, the developer is conveyed to an area with smaller magnetic force, where the developer is moved away from the development sleeve 65 and returned to the agitation section 66.

By repeating the above-described operations, the density of toner contained in the agitation section 66 decreases. The toner density sensor 71 detects the decrease in toner density in the agitation section 66, and based on detected results, additional toner particles are supplied to the agitation section 66.

A primary transfer unit 62 serves as a transfer unit and employs a primary transfer roller to be disposed facing and pressing against the photoconductor 20 via the intermediate transfer belt 10. The primary transfer unit 62 can include a roller-shaped member or a different member in any other shape, for example, a form of electrically conductive brush or a form of non-contact corona charger.

A photoconductor cleaning unit 63 includes a cleaning blade 75 that is made of polyurethane rubber, for example. The cleaning blade 75 is disposed facing the photoconductor 20 by pressing the leading edge thereof against the surface of the photoconductor 20.

In this exemplary embodiment, the photoconductor cleaning unit 63 further includes an electrically conductive fur brush 76 that is disposed in contact with the photoconductor 20 to enhance cleaning ability thereof. Residual toner removed from the photoconductor 20 by the cleaning blade 75 and the electrically conductive fur brush 76 is collected to an inner part of the photoconductor cleaning unit 63.

A discharging unit 64 that includes a discharging lamp emits laser light to initialize a surface potential of the photoconductor 20.

Further, the image forming unit 18 includes an electric potential sensor 120 that serves as a surface potential detector. The electric potential sensor 120 is disposed to face the photoconductor 20 so that a surface potential of the photoconductor 20 can be detected.

In FIG. 3, the charging units 60 uniformly charge the surface of the photoconductor 20 to, for example, minus 700 volts or −700V. For example, when the optical writing device 21 emits laser light beams, the potential of emitted area on the electrostatic latent image can be measured as minus 120 volts or −120V. According to the calculation result, a voltage of developing bias is set to minus 470 volts or −470V to obtain the development electric potential of 350 volts or 350V. These process conditions can be changed when necessary, based on results of a potential setting adjustment, which will be described later.

As previously shown in FIG. 3, in the image forming unit 18, the charging unit 60 uniformly charges the surface of the photoconductor 20 as the photoconductor 20 rotates. Then, based on image data read by the scanner 300, the optical writing device 21 emits the laser light beams to irradiate the surface of the photoconductor 20 so as to form an electrostatic latent image on the surface of the photoconductor 20. Then, the developing unit 61 develops the electrostatic latent image into a visible toner image. The toner image is primarily transferred onto the intermediate transfer belt 10 by performing a primary transfer process. Residual toner particles remaining on the surface of the photoconductor 20 after the primary transfer operation are removed by the photoconductor cleaning unit 63. Then, the surface of the photoconductor 20 is electrically discharged by the discharging unit 64 to be ready for a subsequent image forming operation.

A secondary transfer roller 24 that serves as a secondary transfer unit is disposed to face the third supporting roller 16 of the supporting rollers spanning and extending the intermediate transfer belt 10. The toner image is secondarily transferred onto the transfer sheet 5 conveyed by the intermediate transfer belt 10 by pressing the secondary transfer roller 24 against an area where the intermediate transfer belt 10 is wound around the third supporting roller 16.

The secondary transfer unit is not limited to the secondary transfer roller 24 but can include, for example, a transfer belt member or a non-contact transfer charger. The secondary transfer roller 24 is held in contact with a roller cleaning unit 91 to remove toner that adheres to the secondary transfer roller 24.

Further, an endless transfer belt 22 is extended by and spanned around two rollers 23*a* and 23*b* disposed downstream from the secondary transfer roller 24 in a direction of conveyance of the transfer sheet 5.

Furthermore, a fixing unit 25 is disposed downstream from the endless transfer belt 22 in the direction of conveyance of the transfer sheet 5 so that the fixing unit 25 can fix the toner image to the transfer sheet 5. The fixing unit 25 includes a heat roller 26 and a pressure roller 27 that is pressed against the heat roller 26.

A belt cleaning unit 17 is disposed facing the second supporting roller 15 of the multiple supporting rollers of the intermediate transfer belt 10. After the toner image formed on the intermediate transfer belt 10 is transferred onto the transfer sheet 5, the belt cleaning unit 17 removes residual toner remaining on the surface of the intermediate transfer belt 10.

As shown in FIG. 1, the printing device 100 includes a conveyance path 48 that conveys and guides the transfer sheet 5 fed from the sheet feeding device 200 via the secondary transfer roller 24 to the sheet discharging tray 7, and a conveyance roller 49*a*, a pair of registration rollers 49*b*, and a pair of discharging rollers 56 are also located along the conveyance path 48. A separation claw 55 is disposed downstream from the conveyance path 48 to separate and switch a direction of conveyance of the transfer sheet 5 after transfer so that the transfer sheet 5 is directed to either the sheet discharging tray 7 or a sheet reverse unit 93. The sheet reverse unit 93 reverses and sends the transfer sheet 5 to the secondary transfer roller 24 again.

The printing device 100 further includes a manual sheet feed path 53, a sheet feeding roller 50, and a sheet separation roller 51.

The manual sheet feed path 53 is provided for the transfer sheet 5 to be fed from the manual sheet tray 6 to join the conveyance path 48. The sheet feeding roller 50 and the sheet separation roller 51 are disposed upstream from the manual sheet feed path 53 in the direction of conveyance of the transfer sheet 5 so as to feed the transfer sheet 5 one by one mounted on the manual sheet tray 6.

The sheet feeding device 200 includes multiple sheet feed cassettes 44, sheet feeding rollers 42, separation rollers 45, and conveyance rollers 47.

The multiple sheet feed cassettes 44 accommodate each stack of transfer sheets 5. The sheet feeding rollers 42 and the separation rollers 45 separate and feed the transfer sheet 5 one by one from one of the multiple sheet feed cassettes 44. The conveyance rollers 47 convey the transfer sheet 5 fed by the sheet feeding rollers 42 and the separation rollers 45 along the sheet feed path 46. The sheet feed path 42 is connected to the conveyance path 48 of the printing device 100.

The scanner 300 includes a contact glass 31, a first moving member 33, a second moving member 34, an image forming lens 35, and an image reading sensor 36.

The first and second moving members 33 and 34, each including a light source for illuminating a reading object and a mirror, reciprocally move to scan and read a document (not shown) serving as the reading object placed on the contact glass 31. The first and second moving members 33 and 34 scan image data of the document, and the image forming lens 35 collects the image data to an image forming surface of the image reading sensor 36 that is located behind the image forming lens 35. Then, the image reading sensor 36 reads the image data as image signals.

Figure 4:
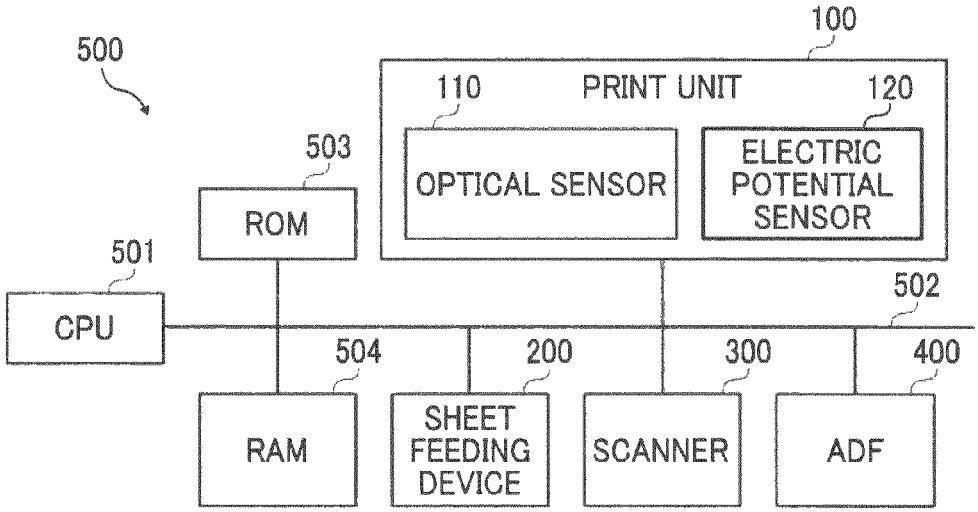
FIG. 4 is a block diagram illustrating a main part of electric circuit of the image forming apparatus of FIG. 1.

FIG. 4 illustrates a main part of electric circuit of the image forming apparatus 1 according to this exemplary embodiment of the present invention.

As shown in FIG. 4, the image forming apparatus 1 further includes a main controller 500 as a computer component to drive and control various units and components incorporated in the image forming apparatus 1.

The main controller 500 includes a central processing unit (CPU) 501, a bus line 502, a read-only memory (ROM) 503, and a random access memory (RAM) 504.

The CPU 501 executes various calculations and driving controls. The CPU 501 is connected via the bus line 502 to the ROM 503 that previously stores fixed data such as computer programs and the RAM 504 that serves as a work area to store various rewritable data. The ROM 503 has a conversion table (not shown) that stores information for converting output values of the optical sensor 110 to each toner adhesion amount per unit area. The main controller 500 is also connected to various units and components of the printing device 100, the sheet feeding device 200, the scanner 300, and the ADF 400. The optical sensor 110 and the electric potential sensor 120 of the printing device 100 transmit detected information to the main controller 500.

The controller 500 formed in combination of the CPU 501, the ROM 503, and the RAM 504 serves as an image density adjusting unit of the image forming apparatus 1 starts an image forming condition control, which is called an electric potential settings control, for adjusting image density and so forth.

Figure 5:
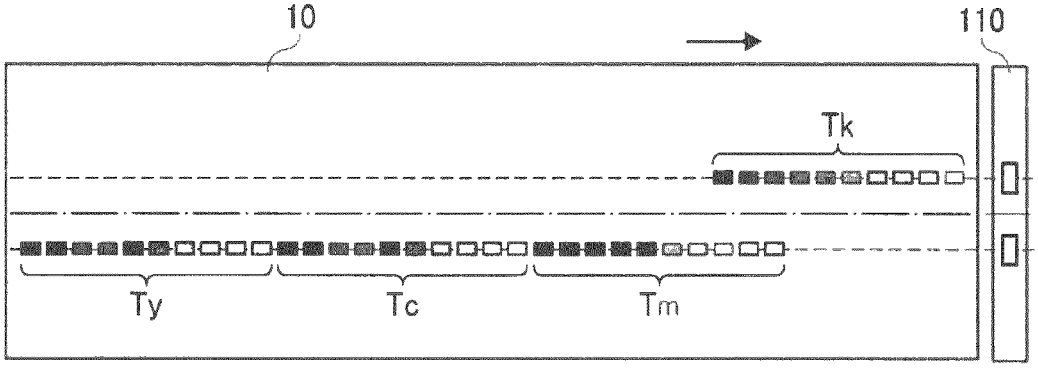
FIG. 5 is a schematic diagram illustrating an intermediate transfer belt provided in the image forming apparatus in FIG. 1 and grayscale level pattern images formed on the surface thereof.

In the electric potential settings control, grayscale-level pattern images are formed on each surface of the photoconductors 20Y, 20C, 20M, and 20K of the image forming units 18Y, 18C, 18M, and 18K and transferred onto the intermediate transfer belt 10. Each grayscale-level pattern image of yellow, magenta, cyan, and black includes multiple reference patches or reference toner images. Each of the reference patches has an individual toner adhesion amount per unit area, that is, these toner adhesion amounts are different from each other. The reference patches are formed on the intermediate transfer belt 10 as shown in FIG. 5, for example. Specifically, a magenta grayscale-level pattern image or M grayscale-level pattern image Tm is formed by multiple reference magenta or M patches, a cyan grayscale-level pattern image or C grayscale-level pattern image Tc is formed by multiple reference cyan or C patches, and a yellow grayscale-level pattern image or Y grayscale-level pattern image Ty is formed by multiple reference yellow or Y patches, and a black grayscale-level pattern image or K grayscale-level pattern image Tk is formed by multiple reference black or K patches. The M, C, and Y grayscale-level pattern images Tm, Tc, and Ty may be transferred onto the intermediate transfer belt 10 in this order in alignment in a direction of movement of the intermediate transfer belt 10. By contrast, the K grayscale-level pattern image Tk may be transferred onto the intermediate transfer belt 10 at a different position from the M, C, and Y grayscale-level pattern image in a belt width direction.

In the electric potential settings control, the optical sensor 110 detects each reference patch of the grayscale-level pattern images (for example, ten grayscale-level patterns) formed on the intermediate transfer belt 10 so that an appropriate development γ (gamma) can be calculated based on output voltages corresponding each reference patch. Based on the calculation results, target charge potentials of the surface of the photoconductor 20 to obtain a target image density (hereinafter referred to as "target charge potential"), developing bias, and optical writing intensity or exposure intensity are specified and the set values or settings are stored. "Development γ" represents a slope of a graph indicating a relation of a development electric potential and a toner adhesion amount per unit area.

Figure 6:
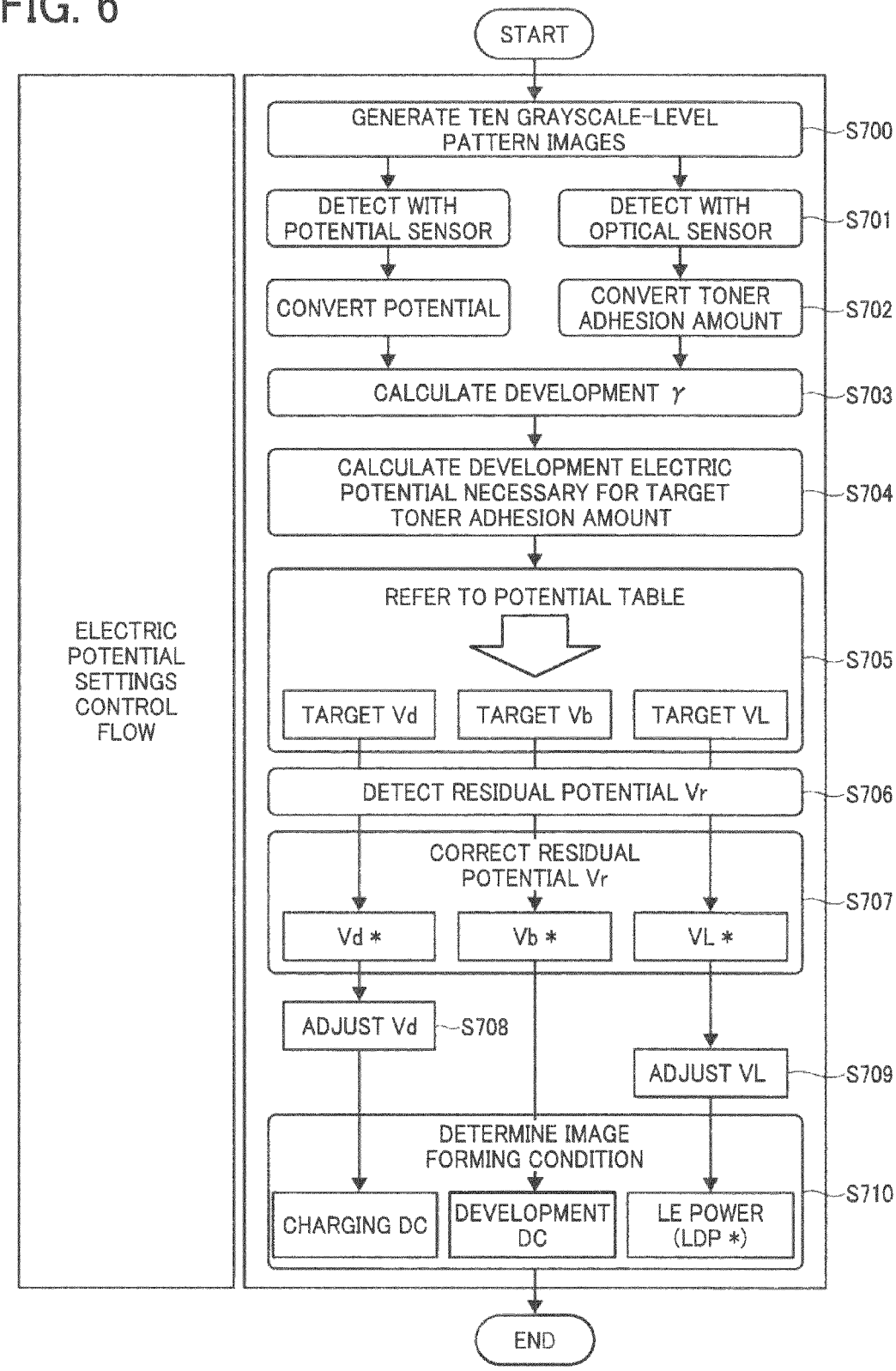
FIG. 6 is a flowchart showing a process flow of potential setting value control performed in the image forming apparatus of FIG. 1.

FIG. 6 illustrates a flowchart showing a control flow in the electric potential settings control performed by the image forming apparatus 1.

In the electric potential settings control, the CPU 501 of the main controller 500 causes the latent image writing device 21 to form respective ten grayscale-level pattern images on the surface of the photoconductor 20, including respective ten reference patches having the toner adhesion amounts different from each other, in step S700.

After step S700, the CPU 501 causes the optical sensor 110 to detect these grayscale-level pattern images and stores the output results in the RAM 504 in step S701. At this time, the CPU 501 reads the output values obtained by the electric potential sensor 120 with respect to each electric potential of each grayscale-level pattern on the photoconductor 20 or each electric potential in the electrostatic latent images and stores the output values of the electric potential sensor 120 in step S701.

After step S701, the CPU 501 of the main controller 500 calculates a development electric potential based on a potential output value of the electric potential sensor 120 that has been stored in the RAM 504 and a developing bias obtained in the pattern image forming, in step S702. At the same time, the CPU 501 obtains a toner adhesion amount of each patch by referring to a toner adhesion amount conversion table (not shown).

After the toner adhesion amount is obtained in step S702, the CPU 501 calculates the development γ in step S703.

Figure 7:
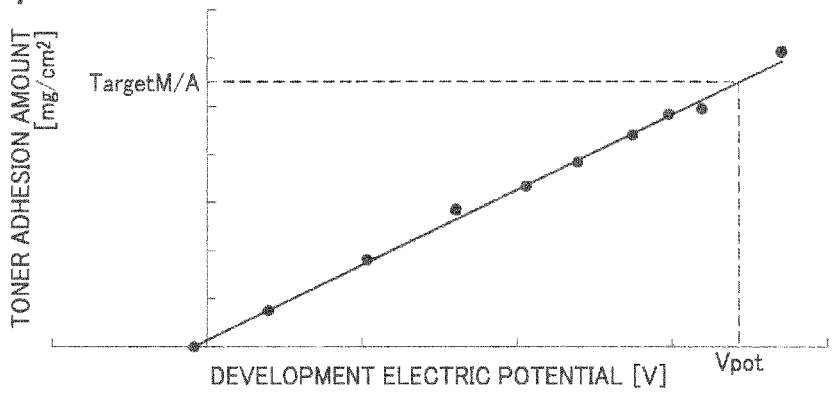
FIG. 7 is a graph showing a relation (feature of development γ) between development electric potential specified based on detection results obtained by the tone pattern images and toner adhesion amount of each reference patch.

FIG. 7 illustrates a graph showing a relation of the development electric potential obtained in step S702 and the toner adhesion amount of each reference patch.

The CPU 501 uses a linear approximation equation shown in the graph of FIG. 7 to calculate the development γ in step S703 in FIG. 6. The slope in the graph of FIG. 7 corresponds to the development γ and a horizontal axis intercept or x-intercept is indicated as a development start voltage.

After the development γ is obtained in step S703, the CPU 5C1 specifies a development electric potential Vpot, which is necessary to obtain a target toner adhesion amount or Target M/A, based on the development γ in step S704.

Then, the CPU 501 of the main controller 500 specifies, in step S705, a photoconductor charge potential, a developing bias potential, and an exposure potential (a potential of electrostatic latent image) of the photoconductor 20 by referring to a potential table (not shown), as a target photoconductor charge potential Vd, a target developing bias potential Vb, and a target potential of electrostatic latent image or target latent image potential VL.

After the target values of photoconductor charge potential Vd, developing bias potential Vb, and latent image potential VL are specified as described above, the CPU 501 executes a procedure in step S706 to increase laser emitting power of a semiconductor laser to its maximum level via a laser control circuit (not shown) that controls the optical writing device 21. Then, the CPU 501 obtains the output values of the electric potential sensor 120 so that a residual potential Vr of the photoconductor 20 can be detected. Then, if the output value of the residual potential Vr is not zero (0), the CPU 501 corrects the target values of photoconductor charge potential Vd, developing bias potential Vb, and latent image potential VL that are specified in advance in step S705 by the amount of the residual potential Vr in step S707. Hereinafter, the corrected target values of photoconductor charge potential Vd, developing bias potential Vb, and latent image potential VL are indicated as corrected target values of photoconductor charge potential Vd*, developing bias potential Vb*, and latent image potential VL*.

After step S707, the CPU 501 executes a procedure in step S708 to adjust a power supply circuit (not shown) so that the charging unit 60 can set the photoconductor charge potential Vd of the photoconductor 20 of each color of toners to the above-described target photoconductor charge potential Vd*. Then, in step S709, the CPU 501 allocates the laser emitting powers in the semiconductor laser to multiple levels via the laser control circuit and obtain laser emission power LDP so that the latent image potential VL* of the photoconductor 20 can be set to the corrected target latent image potential VL*.

Figure 8:
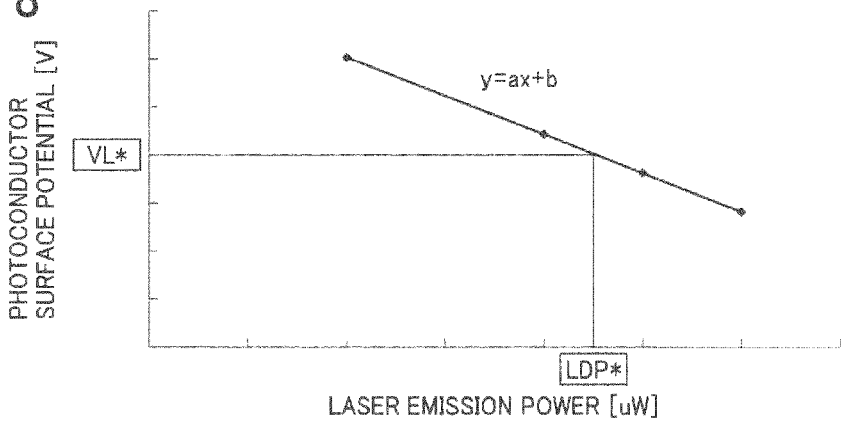
FIG. 8 is a graph showing a relation between laser emission power obtained by the potential setting value control and an electric potential of a photoconductor exposure part.

FIG. 8 illustrates a graph showing a relation of the laser emission power LDP that can be obtained in step S709 and the exposure intensity of development electric potential obtained in step S709 and the toner adhesion amount of each reference patch.

As shown in FIG. 8, the relation between the laser emission power LDP and the latent image potential VL of the photoconductor 20 can be described in a linear approximation equation "y=ax+b", wherein "a" represents a slope and "b" represents an intercept.

In step S709, the CPU 501 stores the slope "a" and the intercept "b" in the RAM 504. The CPU 501 adjusts the power supply circuit, in step S710, so that each of the developing units 61Y, 61C, 61M, and 61K can obtain the target developing bias potential Vb*, and stores the adjusted values as a preliminary image forming condition for printing operation.

At completion of step S710, the processing of the electric potential settings control ends.

Next, a description is given of a development electric field strength control to adjust development electric field strength to be set within an acceptable range of a target electric field strength according to an exemplary embodiment of the present invention.

In the image forming apparatus 1, the RAM 504 serves as a runout amount measurement information storage unit and stores photoconductor runout amount measurement information and sleeve runout amount measurement information. The photoconductor runout amount measurement information can be obtained by measuring a runout amount on the circumference of the photoconductor 20 at two or more positions at the development area where the photoconductor 20 and the development sleeve 65 face each other and the sleeve runout amount measurement information can be obtained by measuring a runout amount on the circumference of the development sleeve 65 at two or more positions at the development area.

Further, the RAM 504 also serves as a development gap measurement information storage unit and stores development gap measurement information that can be obtained by measuring a development gap or distance of closest approach in the development area across a photoconductor runout amount measurement point that measured at least one runout amount in the photoconductor runout amount measurement information and a sleeve runout amount measurement point that measured at least one runout amount in the sleeve runout amount measurement information.

The main controller 500 serves as a development electric field strength controller to obtain each development electric field strength exerted at a position where the photoconductor runout amount measurement point corresponding to a plurality of runout amount data included in the photoconductor runout amount measurement information and the sleeve runout amount measurement point corresponding to a plurality of runout amount data included in the sleeve runout amount measurement information face each other, based on the photoconductor runout amount measurement information, the sleeve runout amount measurement information, and the development gap measurement information that are stored in advance in the RAM 504. Then, the main controller 500 determines the contents of the development electric field strength control so that the entire development electric field strengths obtained as described above are determined to be within an acceptable range of the target development filed strength control, and controls the development electric field strengths according to the determined contents of the development electric field strength control.

Figure 9:
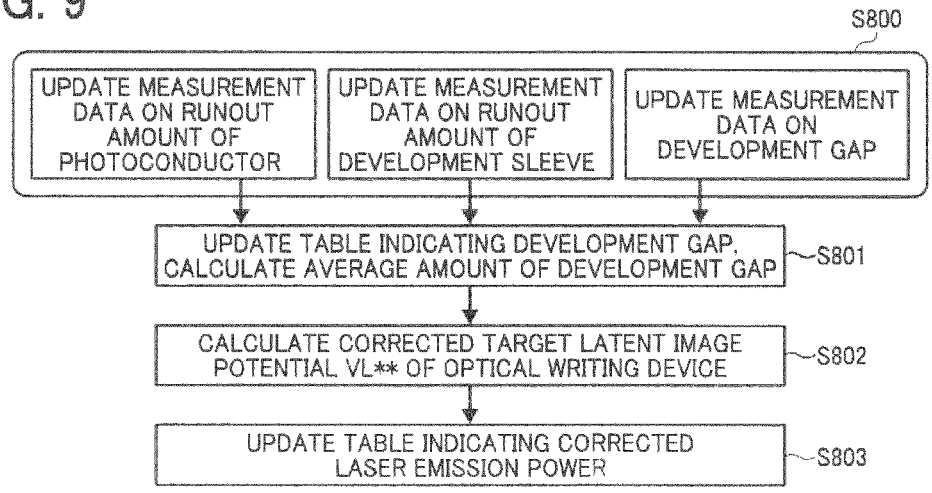
FIG. 9 is a flowchart showing a process flow of development electric field strength control performed in the image forming apparatus of FIG. 1 according to an exemplary embodiment.

FIG. 9 illustrates a flowchart showing a flow of the development electric field strength control conducted by the main controller 500 in the image forming apparatus 1.

In the four image forming units 18Y, 18C, 18M, and 18K of the image forming apparatus 1, when any of the photoconductor runout amount measurement information, the sleeve runout amount measurement information, and the development gap measurement information stored in the RAM 504 of the main controller 500 is updated, the CPU 501 of the main controller 500 determines to execute the development electric field strength control in step S800.

Then, in step S801, the photoconductor 20 and the development sleeve 65 are driven to rotate according to the updated information, which causes the CPU 501 of the main controller 500 to calculate the distance of a closest approach or development gap between the photoconductor runout amount measurement point and the sleeve runout amount measurement point, with the photoconductor 20 and the development sleeve 65 facing each other in the development area, and updates the development gap table based on calculation results.

The development gap table indicates various development gaps across the photoconductor runout amount measurement point and the sleeve runout amount measurement point at the development area where the photoconductor 20 and the development sleeve 65 face each other while they are rotating. Further, an average of all development gaps described in the development gap table is also calculated in step S801.

Subsequently, the CPU 501 of the main controller 500 obtains each development electric field strength at these development gaps, the target latent image potential VL* stored in the RAM 504 in the above-described electric potential settings control is corrected so that all of the obtained development electric field strengths are set within an acceptable range of the target electric field strength, and the corrected target latent image potential VL in step S802**.

Then, a corrected laser emission power LDP is calculated based on the corrected target latent image potential VL and the information obtained by the linear approximation equation between the laser emission power and the photoconductor exposure potential, both stored in the RAM 504 in the above-described electric potential settings control shown in FIG. 8, and the laser emission power table is updated in step S803.

Next, a detailed description is given of each step of the control operations.

Referring to FIGS. 10 through 13, a detailed description of step S800 is described.

FIG. 10 illustrates a perspective view of the photoconductor 20, indicating multiple photoconductor runout amount measurement points. Each photoconductor runout amount measurement point is located on a virtual plane that is located perpendicular to a line O2-O2' that is a central axis of rotation of the photoconductor 20 and on a circumference line 614 that passes through a detection area of the electric potential sensor 120. In this exemplary embodiment, the photoconductor runout amount measurement information can be obtained by placing a runout measuring instrument, for example, a dial gauge, on a runout amount measurement reference point 612, setting a runout value of the runout amount measurement reference point 612 to zero (0), and rotating the photoconductor 20 in a direction indicated by arrow 615 in FIG. 10 over one revolution. The direction indicated by the arrow 615 is identical to a direction of rotation of the photoconductor 20 in the printing device 100 during printing operation. The runout amount or its surface deviation from perfect roundness is measured at every specified angle (unit: "deg") and each runout value toward a direction of the central axis of the photoconductor 20 is indicated as a value with a symbol "–" (minus). The number of measured runout amounts, that is, the number of runout amount measurement points is determined based on integer of "n2", which refers to the number of information of runout amounts obtained at the runout amount measurement reference point 612, and the runout amount measurement point indicated by reference numeral "616" in FIG. 10 is measured at the n2-th (the last point to be measured).

FIG. 11 shows the photoconductor runout amount measurement information.

As shown in FIG. 11, the photoconductor runout amount measurement information includes a region 660 for writing runout amount data obtained at the runout amount measurement reference point 612 and a region 661 for writing runout amount data obtained at the n2-th photoconductor runout amount measurement point 616. The photoconductor runout amount measurement information is affected due to fluctuation in performance of the photoconductor 20, and therefore each photoconductor 20 may need to be measured prior to assembly of the printing device 100. Then, when the photoconductor 20 is assembled into the printing device 100, the photoconductor runout amount measurement information with respect to the photoconductor 20 can be stored in the RAM 504 of the main controller 500 of the image forming apparatus 1.

FIG. 12 illustrates a perspective view of the development sleeve 65, indicating multiple sleeve runout amount measurement points. Each sleeve runout amount measurement point is located on a virtual plane that is located perpendicular to a line O1-O1' that is a central axis of rotation of the development sleeve 65 and on a circumference line 604 of the development sleeve 65 that faces the circumference line 614 of the photoconductor 20. In this exemplary embodiment, the sleeve runout amount measurement information can be obtained by using a runout measuring instrument, for example, a dial gauge, at a runout amount measurement reference point 602, setting a runout value of the runout amount measurement reference point 602 to zero (0), and rotating the development sleeve 65 in a direction indicated by arrow 605 in FIG. 12 over one revolution. The direction indicated by the arrow 605 is identical to a direction of rotation of the development sleeve 65 in the printing device 100 during image printing operation. The runout amount or its surface deviation from perfect roundness is measured at every specified angle (unit: "deg") and each runout toward a direction of the central axis of the development sleeve 65 is indicated as a value with a symbol "–" (minus). The number of measured runout amounts, that is, the number of runout amount measurement points is determined based on integer of "n1", which refers to the number of information of runout amounts obtained at the runout amount measurement reference point 602, and the runout amount measurement point indicated by reference numeral "606" in FIG. 12 is measured at the n1-th (the last point to be measured).

FIG. 13 shows the sleeve runout amount measurement information.

As shown in FIG. 13, the sleeve runout amount measurement information includes a region 650 for writing runout amount data obtained at the runout amount measurement reference point 602 and a region 651 for writing runout amount data obtained at the n1-th sleeve runout amount measurement point 606. The n1 runout amount data written as above is repeatedly written for {(n2/n1)−1} times, that is, until the number of lines of sleeve runout amount measurement information or the number of data of runout amount thereof reaches n2, so as to obtain the sleeve runout amount measurement information.

The sleeve runout amount measurement information is affected due to fluctuation in performance of the development sleeve 65, and therefore each development sleeve 65 may need to be measured prior to assembly of the printing device 100. Then, when the development sleeve 65 is assembled into the printing device 100, the sleeve runout amount measurement information with respect to the development sleeve 65 can be stored in the RAM 504 of the main controller 500 of the image forming apparatus 1.

Further, in this exemplary embodiment of the present invention, when the development sleeve 65 and the photoconductor 20 are assembled to the printing device 100, the runout amount measurement reference points 602 and 612 can be disposed facing each other at a given position (hereinafter, referred to as "home position") across a development gap "d1 [m]", for example. The development gap d1 is measured by a thickness gauge, for example, and the measured value is stored as development gap measurement information in the RAM 505 of the main controller 500.

As described above, when information is stored or rewritten in the RAM 504, the CPU 501 determines that the development electric field strength control is needed and executes the following steps.

Referring to FIGS. 14 and 15, a detailed description of step S801 is described.

FIG. 14 shows a development gap table that indicates the development gap measurement information.

In step S801, the development gap table of FIG. 14 is updated based on the photoconductor runout amount measurement information, the sleeve runout amount measurement information, and the development gap measurement information stored in the RAM 504 of the main controller 500. The value of the development gap measurement information, that is, the development gap "d1 [m]" measured at the home position as development gap data is written in a region 670 of the development gap table. Development gap data written in other regions in the development gap table indicate values obtained by subtracting the development gap d1 [m] measured at the home position by the sum of respective runout amount data of the photoconductor 20 shown in FIG. 11 and respective runout amount data of the development sleeve 65 shown in FIG. 13. In a case where the definition of positive and negative of runout amount data is opposite, the development gap data written in other regions in the development gap table are obtained by adding the development gap d1 [m] measured at the home position to the sum of respective runout amount data of the photoconductor 20 and respective runout amount data of the development sleeve 65. Further, the average value $d_{ave}$ [m] of respective development gap data of the development gap table is calculated by the CPU 501 of the main controller 500 and stored in the RAM 504.

In this exemplary embodiment, phase adjustment may need to be performed so that the runout amount measurement point of the development sleeve 65 and the runout amount measurement point of the photoconductor 20 can face each other when the development sleeve 65 and the photoconductor 20 are rotated. Therefore, an angular velocity ratio (ω1/ω2) of a rotation angular velocity ω1 [rad/s] of the development sleeve 65 and a rotation angular velocity ω2 [rad/s] is set to be identical to a ratio (n2/n1) of the number of runout amount measurements (the number of runout amount measurement points) of the development sleeve 65 and the number of runout amount measurements (the number of runout amount measurement points) of the photoconductor 20.

The following description is given of the reasons for the setting.

FIG. 15 shows relative positions of rotation of the photoconductor 20 and the development sleeve 65 of any of the image forming units 18Y, 18C, 18M, and 18K.

The development sleeve 65 is a cylindrical member having a radius R1 [m] and rotates in a direction indicated by arrow 605 at an angular velocity ω1 [rad/s]. The photoconductor 20 is a drum-shaped member having a radius R2 [m] and rotates in a direction indicated by arrow 615 at an angular velocity ω2 [rad/s]. An angle θ1 indicates a central angle between each runout amount measurement point of the development sleeve 65 and the central part of the development area and angle θ2 indicates a central angle between each runout amount measurement point of the photoconductor 20 and the central part of the development area.

When any runout amount measurement point A in the development sleeve 65 faces any runout amount measurement point C in the photoconductor 20 each other at the development region, the following Equation 2 may need to be satisfied so that runout amount measurement points B and D following the runout amount measurement points A and C, respectively, can reach the development region after an identical time "t" [s] has passed and the development sleeve 65 and the photoconductor 20 face each other at the development area:

$$t==\theta 1/\omega 1=\theta 2/\omega 2 \qquad \text{Equation 2.}$$

Here, based on the relations of θ1=360/n1 and θ2=360/n2, Equation 2 described above can be modified to the following Equation 3:

$$(\omega 1/\omega 2)=n2/n1 \qquad \text{Equation 3.}$$

Accordingly, if Equation 3 is satisfied, a phase of each runout amount measurement point of the photoconductor 20 and a phase of each runout amount measurement point of the development sleeve 65 may match, and therefore the photoconductor 20 and the development sleeve 65 can face each other constantly at the development region.

Referring to FIGS. 16 and 17, a detailed description of the process of step S802 is described.

In step S802, the CPU 501 calculates a corrected target latent image potential VL** based on the target latent image potential VL* obtained at step S707 in the above-described electric potential settings control and the development gap table shown in FIG. 14.

Here, when the development electric potential based on the image forming conditions initially determined in the electric potential settings control is set as Vpot [V], the following Equation 4 is satisfied:

$$V\text{pot}=Vb^*-VL^* \qquad \text{Equation 4.}$$

Further, when the k-th development gap in the table of FIG. 14 is set as a development gap "dk[m]", the following Equation 5 should be satisfied to constantly maintain the development electric field strength E, which is obtained based on the equation "E=Vpot/d":

$$E=V\text{pot}/d_{ave}=(Vb^*-VL^*)/d_{ave}=(Vb^*-VL^{**})/dk \quad \text{Equation 5.}$$

Based on the above-described Equation 5, the following Equation 6 can be obtained:

$$VL^{**}=Vb^*-(Vb^*-VL^*)\times(dk/d_{ave}) \quad \text{Equation 6.}$$

In step S802, the CPU 501 of the main controller 500 calculates the corrected target latent image potential VL that corresponds to each development gap data by using each development gap data written in the development gap table shown in FIG. 14** and Equation 6.

Referring to FIGS. 16 and 17, a detailed description of the process of step S803 is described.

In step S803, the CPU 501 calculates a corrected target laser emission power LDP that corresponds to each target latent image potential VL based on information of the linear approximation equation (e.g., the slope "a" and the intercept "b") indicating the relation of the laser emission power LDP* and the latent image potential VL* stored in the RAM 504 at step S709 in the above-described electric potential settings control and the following Equation 7:

$$LDP^{}=(VL^{}-b)/a \quad \text{Equation 7.}$$

With each corrected laser emission power LDP obtained by this calculation, the laser emission power table that is stored in the RAM 504 in FIG. 16 is updated. The time "t" [s] in this laser emission power table corresponds to the time "t" [s] in Equation 2. This laser emission power table is used when the laser emission power of the semiconductor laser diode is controlled via a laser control circuit, not shown, which controls the optical writing device 21. With this control, the laser emission power LDP can be varied according to duration of time during which the laser emission power is emitted. As described above, by forming or updating a laser emission power table based on each corrected laser emission power LDP**, the contents of the development electric field strength control in which the development electric field strength is determined to be set within an acceptable range of the target electric field strength.

Next, a detailed description is given of an operation of the development electric field strength control during an image forming operation performed after the contents of the development electric field strength control is determined as described above.

When an original document is copied with the image forming apparatus 1, user places the original document on the document table 30 of the ADF 400 or opens the ADF 400 to set the original document on the contact glass 31 of the scanner 300 and close the ADF 400 to press the ADF 400 to hold the original document. Then, when the original document is set on the ADF 400, as the user presses a start button, not shown, the original document is conveyed onto the contact glass 31 and the scanner 300 is driven to start the first and second moving members 33 and 34 to move. By so doing, light emitted by the first moving member 33 reflects on the original document placed on the contact glass 31, then the light is reflected by a mirror of the second moving member 34 and is guided to the reading sensor 36 via the image forming lens 35. As described above, image data of the original document can be read.

Further, when the user press the start button, a drive motor, not shown, rotates one of the multiple supporting rollers 14, 15, and 16 to rotate the intermediate transfer belt 10. At this time, the photoconductor 20 and the development sleeve of the image forming unit 18, which can be any one of the image forming units 18Y, 18C, 18M, and 18K, are set to face their home positions to rotate.

FIG. 17 is a diagram for explaining relative positions of the rotational position of the photoconductor 20, the rotational position of the development sleeve 65, and an optical writing position 617 in any one of the image forming units 18Y, 18C, 18M, and 18K.

In FIG. 17, a length from which a photoconductor runout amount measurement point C that is located in the development area starts to which it reaches the optical writing position 617 is represented as "L [m]". Here, assuming that a duration of time from which the photoconductor runout amount measurement point C starts and to which it reaches the optical writing position 617 is represented as "T [s]", the following Equation 8 is satisfied:

$$T=L/(\omega 2\times R2) \quad \text{Equation 8.}$$

After the time "T [s]" obtained by Equation 8 has passed since the start of rotation of the photoconductor 20, based on image data read by the reading sensor 36 of the scanner 300, the optical writing device 21 emits a laser light beam onto the surface of the photoconductor 20 of the image forming unit 18 while changing the laser emission power according to a time cycle written in the laser emission power table shown in FIG. 16. By so doing, the laser light beam is emitted to, at least, each photoconductor runout amount measurement point at the corrected laser emission power LDP that can regulate the development electric field strength formed when the photoconductor runout amount measurement point reaches the development area. Therefore, an electrostatic latent image with an electric potential to make the development electric field strength constant is formed on the photoconductor 20. As a result, respective electrostatic latent images are developed by the developing unit 61** into respective visible toner images of yellow, cyan, magenta, and black colors, free from density uniformity.

The respective toner images formed as described above are primarily transferred by the primary transfer units 62Y, 62C, 62M, and 62K so as to be sequentially overlaid on the intermediate transfer belt 10. By so doing, an overlaid toner image is formed on the intermediate transfer belt 10.

When the user presses the start button, the sheet feeding roller 42 of the sheet feeding device 200 according to the transfer sheet 5 that is chosen by the user is rotated to feed the transfer sheet 5 from a corresponding one of the sheet feed cassettes 44. The transfer sheet 5 fed from the sheet feed cassettes 44 is separated one by one by the separation roller 45 to enter the sheet feed path 46 to be conveyed by the conveyance roller 47 to the conveyance path 48 in the printing device 100. The transfer sheet 5 is then stopped at the pair of registration rollers 49*b* with the leading edge thereof abutting against the pair of registration rollers 49*b*. The pair of registration rollers 49*b* starts rotating in synchronization with movement of a time of which the overlaid toner image formed on the intermediate transfer belt 10 is conveyed, as described above, to the secondary transfer area that is located facing the secondary transfer roller 24. The transfer sheet 5 conveyed by the pair of registration rollers 49*b* is then conveyed to a gap between the intermediate transfer belt 10 and the secondary transfer roller 24. With the operation of the secondary transfer roller 24, the overlaid toner image formed on the intermediate transfer belt 10 is transferred onto the transfer sheet 5.

Residual toner remaining on the intermediate transfer belt 10 after secondary transfer is removed by the belt cleaning unit 17.

The transfer sheet 5 with sticking to the secondary transfer roller 24 is then conveyed to the fixing unit 25 to fix the toner image to the transfer sheet 5 by application of heat and pressure. After passing through the fixing unit 25, the transfer sheet 5 is conveyed by the pair of discharging rollers 56 to the sheet discharging tray 7 and stacked thereon.

When performing duplex printing, the direction of the transfer sheet 5 is switched after the fixing unit 25 by the separation claw 55 so that the transfer sheet 5 is conveyed to the sheet reverse unit 93. In the sheet reverse unit 93, the transfer sheet 5 is reversed and guided to the secondary transfer roller 24 again.

As described above, the image forming apparatus 1 according to an exemplary embodiment of the present invention includes the photoconductor 20 (which can correspond to any of the photoconductors 20Y, 20C, 20M, and 20K), the optical writing device 21, the development sleeve 65, the developing unit 61, and the main controller 500 that includes the CPU 501 and the RAM 504.

The photoconductor 20 that serves as an image carrier carries an image on a surface thereof and rotate in a given direction.

The optical writing device 21 that serves as a latent image writing device optically writes an electrostatic latent image on the surface of the photoconductor 20 by changing a surface electric potential of the photoconductor 20.

The developing unit 61 includes the development sleeve 65 disposed facing the photoconductor 20 in a development area of the image forming apparatus 1.

The development sleeve 65 carries developer consisting essentially of toner and carrier on a surface thereof and rotating in a given direction. The developing unit 61 attracts the toner adhering to the surface of the development sleeve 65 to the electrostatic latent image formed on the surface of the photoconductor 20 to develop the electrostatic latent image in a development electric field formed between the electrostatic latent image on the surface of the photoconductor 20 and the surface of the development sleeve 65 into a visible toner image that is then transferred onto a recording medium.

The RAM 504 that serves as a runout measurement information storage unit stores runout measurement information of the photoconductor 20 and runout measurement information of the development sleeve 65. The runout measurement information of the photoconductor 20 includes runout amounts on the circumference of the photoconductor 20 in the development area and associates runout amount data obtained by measuring multiple runout measurement points located on the surface of the photoconductor 20 in a direction of movement of the surface of the photoconductor 20 with runout measurement point data indicating each of the multiple runout measurement points. The runout measurement information of the development sleeve 65 includes runout amounts on the circumference of the development sleeve 65 in the development area and associates runout amount data obtained by measuring multiple runout measurement points located on the surface of the development sleeve 65 in a direction of movement of the surface of the development sleeve 65 with runout measurement point data indicating each of the multiple runout measurement points.

The development gap measurement information storage unit stores development gap measurement information obtained by measuring a development gap at a time when a runout measurement point indicated in at least one of the runout measurement point data of the runout measurement information of the photoconductor 20 and a runout measurement point indicated in at least one of the runout measurement point data of the runout measurement information of the development sleeve 65 come to face each other.

The development electric field strength control unit obtains development electric field strength each time the runout measurement point indicated by the multiple runout measurement point data of the runout measurement information of the photoconductor 20 and the runout measurement point indicated by the multiple runout measurement point data of the runout measurement information of the development sleeve 65 cone to face each other in the development area, based on the runout measurement information of the photoconductor 20 and the runout measurement information of the development sleeve 65 stored in the runout measurement information storage unit and the development gap measurement information stored in the development gap measurement information storage unit. Then, the development electric field strength control unit determines development electric field strength control contents to cause all obtained development electric field strengths to fall within an acceptable target range for the development electric field strength, and performs development electric field strength control according to the control contents.

According to the above-described configuration, even if the development gap has been fluctuated due to runout of the photoconductor 20 and runout of the development sleeve 65, the changes in the target electric field strength can be set within the acceptable range of the target electric field strength. Further in this exemplary embodiment, it is not necessary to form additional reference toner images to execute the development electric field strength control. Therefore, an increase in machine-down time caused by forming such reference toner images and an increase in toner consumption amount can be prevented effectively.

Further, the development electric field strength control performed by the development electric field strength controller comprises controlling the latent image writing device to adjust a potential of an electrostatic latent image formed on each runout measurement point on the surface of the image carrier that corresponds to each of the development electric field strengths. By so doing, the entire development electric field strength when these runout amount measurement points are on the development area can be set within the target electric field strengths. The development electric field strength control can be conducted by a method other than the method of controlling the optical writing device 21. It is, however, preferable to control the optical writing device 21 since the control of the optical writing device 21 can be performed rather easily and with accuracy.

Further in an exemplary embodiment of the present invention, the image forming apparatus 1 further includes an optical sensor 110 and an electric potential sensor 120. The electric potential sensor 120 that serves as a surface potential detector detects the surface potential of the photoconductor 20. The optical sensor 110 that serves as a toner adhesion detector detects a toner adhesion amount of a given reference toner image.

The main controller 500 further serves as an image density adjusting unit to adjust image density by obtaining a relation between a potential of an electrostatic latent image formed by the optical writing device 21 on the photoconductor 20 and exposure intensity of the optical writing device 21 based on detection results obtained by the electric potential sensor 120 and detection results obtained by the optical sensor 110 and adjusting the laser emission power of the optical writing device 21 based on the relation so as to obtain a target potential of the electrostatic latent image for obtaining a predetermined image density. The main controller 500 then determines the development electric field strength control contents after the electric potential settings control. Accordingly, even when the development electric field strength control and the electric potential settings control are executed concurrently, the development electric field strength can be set within the acceptable range of the target electric field strength stably.

Further in an exemplary embodiment of the present invention, the runout measurement information of the photoconductor 20 and the development gap measurement information are obtained based on respective runout amounts measured at points located on the surface of the photoconductor 20, those points passing through a detection area where the electric potential sensor 120 performs detection. Accordingly, the development electric field strength at each measurement point can be obtained more precisely, and therefore the development electric field strengths can be set within the range of the target electric field strength with more accuracy.

Further in an exemplary embodiment of the present invention, the main controller 500 executes the development electric field strength control to adjust the exposure strength of the optical writing device 21 based on the relation (linear approximation equation: $y=ax+b$) obtained in the electric potential settings control, so that an electric potential of the electrostatic latent image formed at each runout measurement point on the surface of the photoconductor 20 causes the entire development electric field strengths for the electric potential to fall within an acceptable target range for the electric field strength. By using the relation obtained in the electric potential settings control, efficient and quick processes can be performed.

Further in an exemplary embodiment of the present invention, the main controller 500 determines the contents of the development electric field strength control each time information stored in the RAM 504 is updated. Accordingly, the development electric field strength can be controlled according to updated contents that correspond to the updated information stored in the RAM 504.

Further in an exemplary embodiment of the present invention, a relation $\omega 1/\omega 2=n2/n1$ is satisfied, where "n1" represents the number of runout measurement points included in the runout measurement information of the development sleeve 65, "n2" represents the number of runout measurement point data included in the runout measurement information of the photoconductor 20, "ω1" represents an angular velocity at rotation of the development sleeve 65, and "ω2" represents an angular velocity at rotation of the photoconductor 20. With this configuration, the phase of each runout amount measurement point on the surface of the photoconductor 20 and the phase of each runout amount measurement point on the surface of the development sleeve 65 match, and the both points constantly face each other in the development area. Accordingly, the development electric field strengths can be set within the acceptable range of the target development electric field strength more precisely.

Further in an exemplary embodiment of the present invention, the runout measurement information of the photoconductor 20 includes the runout amount data in which the runout measurement points thereof are arranged in a direction of rotation of the photoconductor 20, and the runout measurement information of the development sleeve 65 includes the runout amount data in which the runout measurement points thereof are arranged in a direction of rotation of the development sleeve 65. With this configuration, the process can be conducted efficiently.

In this exemplary embodiment, the image forming apparatus 1 has been explained to have a configuration in which the development electric field strength control is executed with the electric potential settings control. However, the development electric field strength control can also be executed alone.

Further, in this exemplary embodiment, the image forming apparatus 1 has been explained to have a configuration employing an intermediate transfer method in which a toner image formed on the surface of the photoconductor 20 is transferred via the intermediate transfer belt 10 onto the transfer sheet 5. However, the image forming apparatus 1 is not limited to this configuration but can have a configuration employing a direct transfer method. Specifically, the image forming apparatus 1 may include a sheet conveyance belt that is disposed facing a photoconductor at a given position and carries a transfer sheet on the surface of the sheet conveyance belt so that a toner image formed on the surface of a photoconductor can be transferred onto the transfer sheet directly. With the configuration, reference patch patterns are transferred not onto the transfer sheet held on the surface of the sheet conveyance belt but onto the surface of the sheet conveyance belt. By so doing, the reference patch patterns on the surface of the sheet conveyance belt can be detected by an optical sensor.

Further, the above description has been explained various configurations applied to a full-color image forming apparatus such as a full-color copier for forming a full-color toner image by transferring and overlaying multiple single color toner images. However, the exemplary embodiment of the present invention can also be applied to image forming apparatuses for forming monochrome toner images.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. An image forming apparatus, comprising:

an image carrier to carry an image on a surface thereof and rotate in a given direction;

a latent image writing device to optically write an electrostatic latent image on the surface of the image carrier by changing a surface electric potential of the image carrier;

a developing unit including a developer carrier disposed facing the image carrier in a development area of the image forming apparatus, the developer carrier carrying developer consisting essentially of toner and carrier on a surface thereof and rotating in a given direction, the developing unit attracting the toner adhering to the surface of the developer carrier to the electrostatic latent image formed on the surface of the image carrier to develop the electrostatic latent image in a development electric field formed between the electrostatic latent image on the surface of the image carrier and the surface of the developer carrier into a visible toner image that is then transferred onto a recording medium;

a runout measurement information storage unit to store runout measurement information of the image carrier and runout measurement information of the developer carrier, the runout measurement information of the image carrier including runout amounts on the circumference of the image carrier in the development area and associating runout amount data obtained by measuring multiple runout measurement points located on the surface of the image carrier in a direction of movement of the surface of the image carrier with runout measurement point data indicating each of the multiple runout measurement points, the runout measurement information of the developer carrier including runout amounts on the circumference of the developer carrier in the development area and associating runout amount data obtained by measuring multiple runout measurement points located on the surface of the developer carrier in a direction of movement of the surface of the developer carrier with runout measurement point data indicating each of the multiple runout measurement points;

a development gap measurement information storage unit to store development gap measurement information obtained by measuring a development gap at a time when a runout measurement point indicated in at least one of the runout measurement point data of the runout measurement information of the image carrier and a runout measurement point indicated in at least one of the runout measurement point data of the runout measurement information of the developer carrier come to face each other; and a development electric field strength control unit to obtain development electric field strength each time the runout measurement point indicated by the multiple runout measurement point data of the runout measurement information of the image carrier and the runout measurement point indicated by the multiple runout measurement point data of the runout measurement information of the developer carrier come to face each other in the development area, based on the runout measurement information of the image carrier and the runout measurement information of the developer carrier stored in the runout measurement information storage unit and the development gap measurement information stored in the development gap measurement information storage unit, the development electric field strength control unit determining development electric field strength control contents to cause all obtained development electric field strengths to fall within an acceptable target range for the development electric field strengths, and performing development electric field strength control according to the control contents.

2. The image forming apparatus according to claim 1, wherein the development electric field strength control performed by the development electric field strength control unit comprises controlling the latent image writing device to adjust a potential of an electrostatic latent image formed on each runout measurement point on the surface of the image carrier that corresponds to each of the development electric field strengths.

3. The image forming apparatus according to claim 2, wherein the image carrier is a photoconductor and the latent image writing device is an exposure unit to change a surface potential of the image carrier by exposing the surface of the image carrier, the image forming apparatus further comprising:

a surface potential detector to detect the surface potential of the latent image carrier;

a toner adhesion detector to detect a toner adhesion amount of a given reference toner image; and an image density adjusting unit to adjust image density by obtaining a relation between a potential of an electrostatic latent image formed by the latent image writing device on the image carrier and an exposure intensity of the latent image writing device based on detection results obtained by the surface potential detector and detection results obtained by the toner adhesion detector and adjusting the exposure intensity of the latent image writing device based on the relation to obtain a target potential of the electrostatic latent image for obtaining a predetermined image density, the development electric field strength control unit determining the contents of the development electric field strength control after the image density adjusting unit has adjusted the image density.

4. The image forming apparatus according to claim 3, wherein the runout measurement information of the image carrier and the development gap measurement information are obtained based on respective runout amounts measured at the multiple runout measurement points located on the surface of the image carrier that pass through the detection area where the surface potential detector performs detection.

5. The image forming apparatus according to claim 3, wherein the development electric field strength control unit controls the latent image writing device to adjust the exposure strength of the latent image writing device based on the relation obtained by the image density adjusting unit, so that an electric potential of the electrostatic latent image formed at each runout measurement point on the surface of the image carrier causes the entire development electric field strength for the electric potential to fall within an acceptable target range for the electric field strength.

6. The image forming apparatus according to claim 1, wherein the development electric field strength control unit determines the contents of the development electric field strength control each time at least one of the runout measurement information storage unit and the development gap measurement information storage unit is updated.

7. The image forming apparatus according to claim 1, wherein a relation $\omega 1/\omega 2=n2/n1$ is satisfied, where "n1" represents the number of runout measurement points included in the runout measurement information of the developer carrier, "n2" represents the number of runout measurement point data included in the runout measurement information of the image carrier, "ω1" represents an angular velocity at rotation of the developer carrier, and "ω2" represents an angular velocity at rotation of the image carrier.

8. The image forming apparatus according to claim 1, wherein the runout measurement information of the image carrier includes the runout amount data in which the runout measurement points thereof are arranged in a direction of rotation of the image carrier, and the runout measurement information of the developer carrier includes the runout amount data in which the runout measurement points thereof are arranged in a direction of rotation of the developer carrier.

9. A method of controlling a development electric field strength, comprising:

measuring multiple runout measurement points located on a surface of an image carrier of an image forming apparatus in a direction of movement of the surface of the image carrier;

obtaining runout amount data of runout amounts at the multiple runout measurement points on the circumference of the image carrier in a development area;

storing the runout amount data associated with runout measurement point data indicating each of the multiple runout measurement points, as runout measurement information of the image carrier in a runout measurement information storage unit;

measuring multiple runout measurement points located on a surface of a developer carrier of the image forming apparatus in a direction of movement of the surface of the developer carrier;

obtaining runout amount data of runout amounts at the multiple runout measurement points on the circumference of the developer carrier in the development area;

storing the runout amount data associated with runout measurement point data indicating each of the multiple runout measurement points, as runout measurement information of the developer carrier in the runout measurement information storage unit;

measuring a development gap formed between the developer carrier and the image carrier when a runout measurement point indicated in at least one of the runout measurement point data of the image carrier and a runout measurement point indicated in at least one of the runout measurement point data of the developer carrier come to face each other in the development area;

storing the development gap as development gap measurement information in a development gap measurement information storage unit;

obtaining development electric field strength each time the runout measurement point indicated by the multiple runout measurement point data of the runout measurement information of the image carrier and the runout measurement point indicated by the multiple runout measurement point data of the runout measurement information of the developer carrier come to face each other in the development area, based on the runout measurement information of the image carrier and the runout measurement information of the developer carrier stored in the runout measurement information storage unit and the development gap measurement information stored in the development gap measurement information storage unit;

determining development electric field strength control contents to cause all obtained development electric field strengths to be set within an acceptable target range for the development electric field strengths; and performing development electric field strength control according to the control contents.

* * * * *